US011660860B2

(12) United States Patent
Yoshida

(10) Patent No.: US 11,660,860 B2
(45) Date of Patent: May 30, 2023

(54) LIQUID JET HEAD AND LIQUID JET RECORDING DEVICE

(71) Applicant: SII PRINTEK INC., Chiba (JP)

(72) Inventor: Kensuke Yoshida, Chiba (JP)

(73) Assignee: SII PRINTEK INC., Chiba (JP)

( * ) Notice: Subject to any disclaimer, the term of this patent is extended or adjusted under 35 U.S.C. 154(b) by 116 days.

(21) Appl. No.: 17/478,181

(22) Filed: Sep. 17, 2021

(65) Prior Publication Data

US 2022/0097361 A1 Mar. 31, 2022

(30) Foreign Application Priority Data

Sep. 28, 2020 (JP) ..... JP2020-162449

(51) Int. Cl.
*B41J 2/045* (2006.01)

(52) U.S. Cl.
CPC ..... *B41J 2/04541* (2013.01); *B41J 2/0452* (2013.01); *B41J 2/04518* (2013.01); *B41J 2/04581* (2013.01)

(58) Field of Classification Search
CPC ..... B41J 2/04581
See application file for complete search history.

(56) References Cited

U.S. PATENT DOCUMENTS

2004/0075636 A1* 4/2004 Pai ..... G06F 3/1446 345/103
2011/0279166 A1* 11/2011 Umeda ..... H05K 1/025 327/365
2012/0188603 A1* 7/2012 Pilsl ..... H04L 12/4625 358/1.15
2014/0327717 A1* 11/2014 Umeda ..... B41J 2/04541 347/17

FOREIGN PATENT DOCUMENTS

GB 2503943 A * 1/2014 ..... B41J 2/04505
JP 2008251847 A * 10/2008 ..... B41J 2/45
JP 2011-046160 A 3/2011

* cited by examiner

*Primary Examiner* — Shelby L Fidler
(74) *Attorney, Agent, or Firm* — Crowell & Moring LLP

(57) ABSTRACT

A liquid jet head and so on capable of reducing both of a manufacturing cost and power consumption are provided. The liquid jet head according to an embodiment of the present disclosure is provided with a jet section and at least one drive board. The drive board is provided with a first input terminal and a second input terminal, a plurality of drive devices, a plurality of transmission lines, and a plurality of terminal resistors. The drive devices each have a first input/output section and a second input/output section. The plurality of drive devices include a first drive device and a second drive device. The plurality of transmission lines include a first transmission line, a second transmission line, and at least one third transmission line. The plurality of termination resistors include a first termination resistor, a second termination resistor, and a third termination resistor.

5 Claims, 11 Drawing Sheets

MODIFIED EXAMPLE 1

MODIFIED EXAMPLE 2

MODIFIED EXAMPLE 4

MODIFIED EXAMPLE 4

LIQUID JET HEAD AND LIQUID JET RECORDING DEVICE

RELATED APPLICATIONS

This application claims priority to Japanese Patent Application No. 2020-162449, filed on Sep. 28, 2020, the entire content of which is incorporated herein by reference.

BACKGROUND OF THE INVENTION

1. Field of the Invention

The present disclosure relates to a liquid jet head and a liquid jet recording device.

2. Description of the Related Art

Liquid jet recording devices equipped with liquid jet heads are used in a variety of fields, and a variety of types of liquid jet heads have been developed (see, e.g., JP-A-2011-46160 (Document 1)).

In such a liquid jet head, in general, it is required to reduce the manufacturing cost and the power consumption.

It is desirable to provide a liquid jet head and a liquid jet recording device in which both of the manufacturing cost and the power consumption can be reduced.

SUMMARY OF THE INVENTION

The liquid jet head according to an embodiment of the present disclosure includes a jet section configured to jet liquid, and at least one drive board configured to output a drive signal used to jet the liquid to the jet section. The drive board includes a first input terminal and a second input terminal to which transmission data transmitted from an outside of the liquid jet head is input, a plurality of drive devices which are in a series arrangement with each other between the first input terminal and the second input terminal, and which is configured to generate the drive signal based on the transmission data input via either one of the first input terminal and the second input terminal, a plurality of transmission lines which are disposed via the plurality of drive devices which are in the series arrangement with each other between the first input terminal and the second input terminal, and which are configured to transmit the transmission data, and a plurality of termination resistors disposed on the plurality of transmission lines. The drive devices each have a first input/output section and a second input/output section which are configured to input or output the transmission data. The plurality of drive devices include a first drive device located at one end of the series arrangement, and a second drive device located at another end of the series arrangement. The plurality of transmission lines include a first transmission line configured to couple the first input terminal and the first input/output section in the first drive device to each other, a second transmission line configured to couple the second input terminal and the second input/output section in the second drive device to each other, and at least one third transmission line configured to couple the second input/output section in the first drive device and the first input/output section in the second drive device to each other. The plurality of termination resistors include a first termination resistor disposed in a vicinity of the first input/output section in the first drive device on the first transmission line, a second termination resistor disposed in a vicinity of the second input/output section in the second drive device on the second transmission line, and a third termination resistor disposed in a vicinity of one end or another end on each of the at least one third transmission line.

The liquid jet recording device according to an embodiment of the present disclosure includes the liquid jet head according to the embodiment of the present disclosure.

According to the liquid jet head and the liquid jet recording device related to an embodiment of the present disclosure, it becomes possible to reduce both of the manufacturing cost and the power consumption.

DETAILED DESCRIPTION OF THE PREFERRED EMBODIMENTS

An embodiment of the present disclosure will hereinafter be described in detail with reference to the drawings. It should be noted that the description will be presented in the following order.

1. Embodiment (Arrangement Configuration Example of Drive Device, Transmission Line, and Termination Resistor)
2. Modified Example 1 through Modified Example 4 (Other Arrangement Configuration Examples of Termination Resistor)
3. Other Modified Examples

1. Embodiment

[Schematic Configuration of Printer 5]

Figure 1:
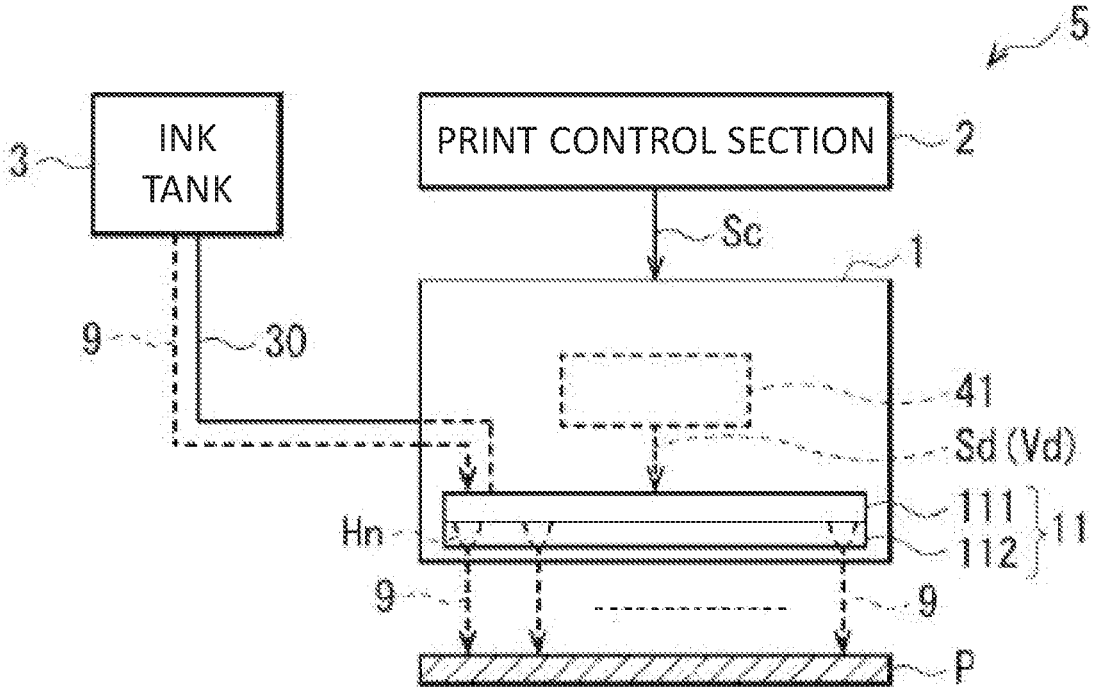
FIG. 1 is a block diagram showing a schematic configuration example of a liquid jet device according to an embodiment of the present disclosure.
Figure 2:
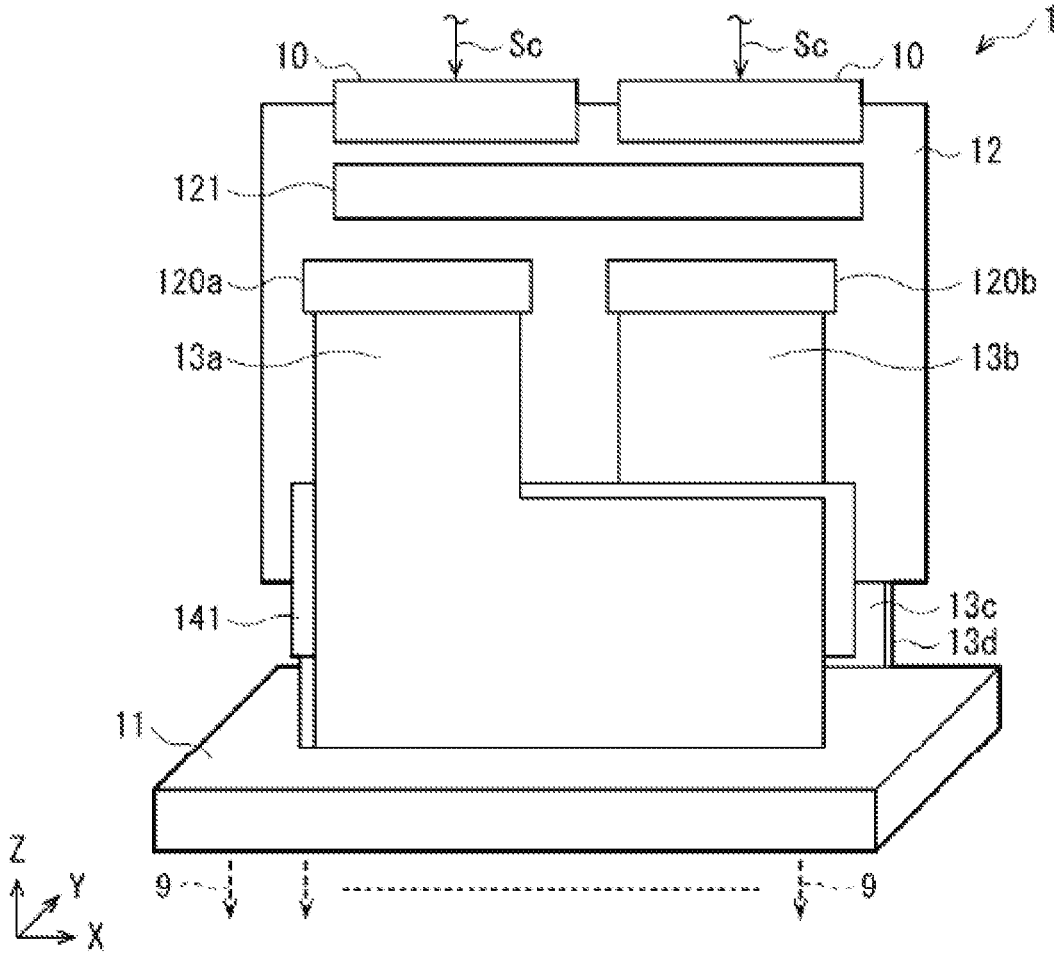
FIG. 2 is a perspective view schematically showing a schematic configuration example of a liquid jet head shown in FIG. 1.
Figure 3:
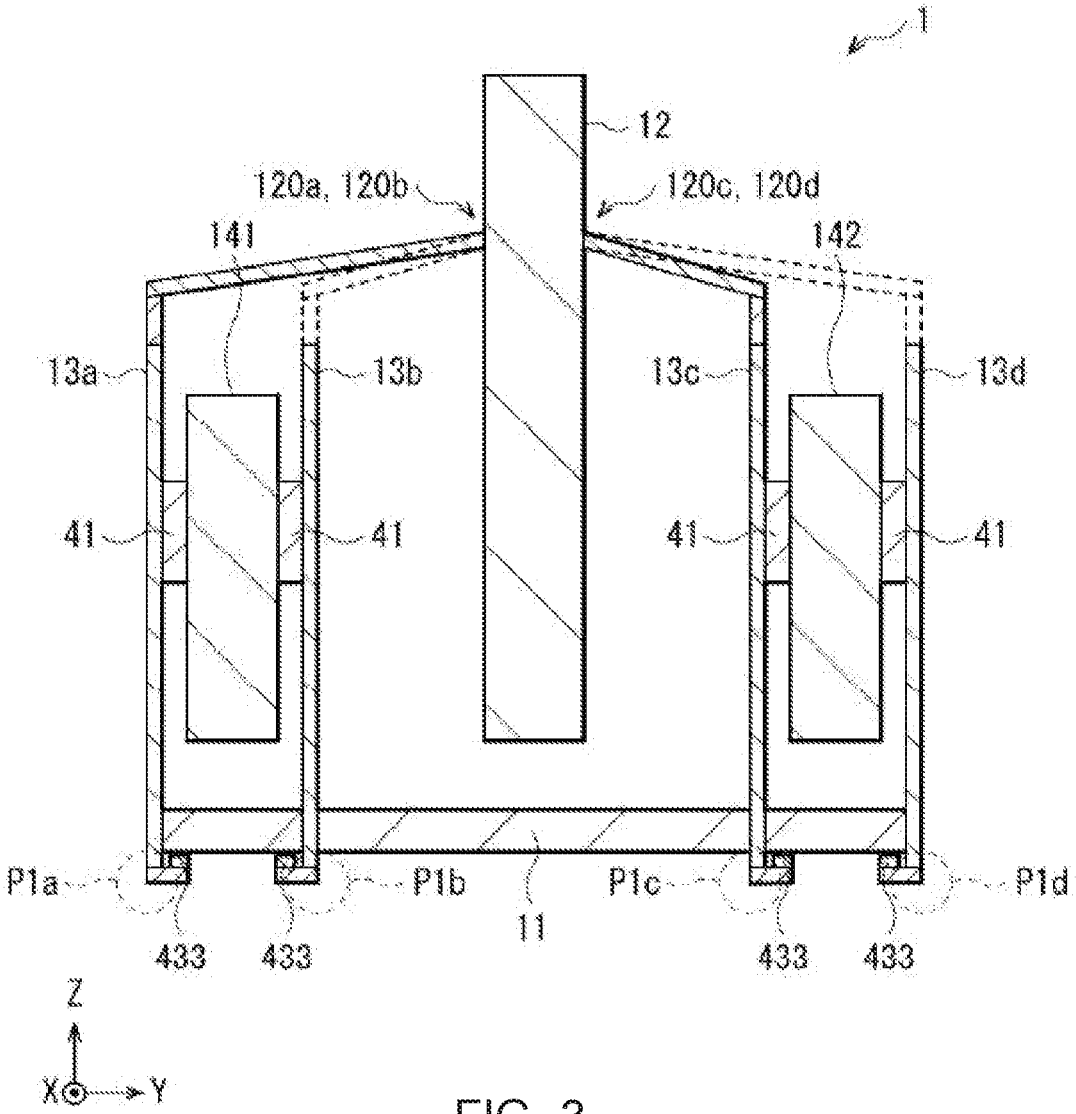
FIG. 3 is a cross-sectional view schematically showing a configuration example of the liquid jet head shown in FIG. 2.

FIG. 1 is a block diagram showing a schematic configuration example of a printer 5 as a liquid jet recording device according to an embodiment of the present disclosure. FIG. 2 is a perspective diagram schematically showing a schematic configuration example of an inkjet head 1 as a liquid jet head shown in FIG. 1. FIG. 3 is a cross-sectional view (a Y-Z cross-sectional view) schematically showing a configuration example of the inkjet head 1 shown in FIG. 2.

It should be noted that the scale size of each of the members is accordingly altered so that the member is shown large enough to recognize in the drawings used in the description of the specification.

The printer 5 is an inkjet printer for performing recording (printing) of images, characters, and the like on a recording target medium (e.g., recording paper P shown in FIG. 1) using ink 9 described later. As shown in FIG. 1, the printer 5 is provided with the inkjet head 1, a print control section 2, and an ink tank 3.

It should be noted that the inkjet head 1 corresponds to a specific example of a "liquid jet head" in the present disclosure, and the printer 5 corresponds to a specific example of a "liquid jet recording device" in the present disclosure. Further, the ink 9 corresponds to a specific example of a "liquid" in the present disclosure.

(A. Print Control Section 2)

The print control section 2 is for supplying the inkjet head 1 with a variety of types of information (data). Specifically, as shown in FIG. 1, the print control section 2 is arranged to supply each of constituents (drive devices 41 described later and so on) in the inkjet head 1 with a print control signal Sc.

It should be noted that the print control signal Sc is arranged to include, for example, image data, an ejection timing signal, and a power supply voltage for operating the inkjet head 1.

(B. Ink Tank 3)

The ink tank 3 is a tank for containing the ink 9 inside. As shown in FIG. 1, the ink 9 in the ink tank 3 is arranged to be supplied to the inside (a jet section 11 described later) of the inkjet head 1 via an ink supply tube 30. It should be noted that such an ink supply tube 30 is formed of, for example, a flexible hose having flexibility.

(C. Inkjet Head 1)

As represented by dotted arrows in FIG. 1, the inkjet head 1 is a head for jetting (ejecting) the ink 9 having a droplet shape from a plurality of nozzle holes Hn described later to the recording paper P to thereby perform recording of images, characters, and so on. As shown in, for example, FIG. 2 and FIG. 3, the inkjet head 1 is provided with a single jet section 11, a single I/F (interface) board 12, four flexible boards 13*a*, 13*b*, 13*c*, and 13*d*, and two cooling units 141, 142.

(C-1. I/F Board 12)

As shown in FIG. 2 and FIG. 3, the I/F board 12 is provided with two connectors 10, four connectors 120*a*, 120*b*, 120*c*, and 120*d*, and a circuit arrangement area 121.

As shown in FIG. 2, the connectors 10 are each a part (a connector part) for inputting the print control signal Sc described above and supplied from the print control section 2 toward the inkjet head 1 (the flexible boards 13*a*, 13*b*, 13*c*, and 13*d* described later).

The connectors 120*a*, 120*b*, 120*c*, and 120*d* are parts (connector parts) for electrically coupling the I/F board 12 and the flexible boards 13*a*, 13*b*, 13*c*, and 13*d*, respectively.

The circuit arrangement area 121 is an area where a variety of circuits are arranged on the I/F board 12. It should be noted that it is also possible to arrange that such a circuit arrangement area is disposed in other areas on the I/F board 12.

(C-2. Jet Section 11)

As shown in FIG. 1, the jet section 11 is a part which has the plurality of nozzle holes Hn, and jets the ink 9 from these nozzle holes Hn. Such jet of the ink 9 is arranged to be performed (see FIG. 1) in accordance with a drive signal Sd (a drive voltage Vd) supplied from each of the drive devices 41 described later on each of the flexible boards 13*a*, 13*b*, 13*c*, and 13*d*.

As shown in FIG. 1, such a jet section 11 is configured including an actuator plate 111 and a nozzle plate 112.

(Nozzle Plate 112)

The nozzle plate 112 is a plate formed of a film material such as polyimide, or a metal material, and has the plurality of nozzle holes Hn described above as shown in FIG. 1. These nozzle holes Hn are formed side by side at predetermined intervals, and each have, for example, a circular shape.

Specifically, in the example of the jet section 11 shown in FIG. 2, the plurality of nozzle holes Hn in the nozzle plate 112 are constituted by a plurality of nozzle arrays (four nozzle arrays) in which the nozzle holes are arranged along the column direction (the x-axis direction). Further, these four nozzle arrays are arranged side by side along a direction (the Y-axis direction) perpendicular to the column direction.

(Actuator Plate 111)

The actuator plate 111 is a plate formed of a piezoelectric material such as PZT (lead zirconate titanate). The actuator plate 111 is provided with a plurality of channels (pressure chambers). These channels are each a part for applying a pressure to the ink 9, and are arranged side by side so as to be parallel to each other at predetermined intervals. Each of the channels is partitioned with drive walls (not shown) formed of a piezoelectric body, and forms a groove section having a recessed shape in a cross-sectional view.

In such channels, there exist ejection channels for ejecting the ink 9, and dummy channels (non-ejection channels) which do not eject the ink 9. In other words, it is arranged that the ejection channels are filled with the ink 9 on the one hand, but the dummy channels are not filled with the ink 9 on the other hand. It should be noted that it is arranged that filling of the ink 9 to each of the ejection channels is performed via, for example, a flow channel (a common flow channel) commonly communicated with such ejection channels. Further, it is arranged that each of the ejection channels is individually communicated with the nozzle hole Hn in the nozzle plate 112 on the one hand, but each of the dummy channels is not communicated with the nozzle hole Hn on the other hand. These ejection channels and the dummy channels are alternately arranged side by side along the column direction (the X-axis direction) described above.

Further, on the inner side surfaces opposed to each other in the drive wall described above, there are respectively disposed drive electrodes. As the drive electrodes, there exist common electrodes disposed on the inner side surfaces facing the ejection channels, and active electrodes (individual electrodes) disposed on the inside surfaces facing the dummy channels. These drive electrodes and the drive devices 41 described later are electrically coupled to each other via each of the flexible boards 13*a*, 13*b*, 13*c*, and 13*d*. Thus, it is arranged that the drive voltages Vd (the drive signals Sd) described above are applied to the drive electrodes from the drive devices 41 via the flexible boards 13*a*, 13*b*, 13*c*, and 13*d*.

(C-3. Flexible Boards 13*a*, 13*b*, 13*c*, and 13*d*)

The flexible boards 13*a*, 13*b*, 13*c*, and 13*d* are each a board for electrically coupling the I/F board 12 and the jet section 11 as shown in FIG. 2 and FIG. 3. It is arranged that these flexible boards 13*a*, 13*b*, 13*c*, and 13*d* individually control the jet operations of the ink 9 in the four nozzle columns in the nozzle plate 112 described above, respectively. Further, as indicated by, for example, the reference symbols P1*a*, P1*b*, P1*c*, and P1*d* in FIG. 3, it is arranged that the flexible boards 13*a*, 13*b*, 13*c*, and 13*d* are folded around places (around clamping electrodes 433) where the flexible boards 13*a*, 13*b*, 13*c*, and 13*d* have contact with the jet section 11, respectively. It should be noted that it is arranged that electrical coupling between the clamping electrodes 433 and the jet section 11 is achieved by, for example, thermo-compression bonding using an ACF (Anisotropic Conductive Film).

On each of such flexible boards 13*a*, 13*b*, 13*c*, and 13*d*, there are individually mounted the drive devices 41 (see FIG. 3). These drive devices 41 are each a device for outputting the drive signal Sd (the drive voltage Vd) for jetting the ink 9 from the nozzle holes Hn in the corresponding nozzle array in the jet section 11. Therefore, it is arranged that such a drive signal Sd is output from each of the flexible boards 13*a*, 13*b*, 13*c*, and 13*d* to the jet section 11. It should be noted that such drive device devices 41 are each formed of, for example, an ASIC (Application Specific Integrated Circuit).

Further, these drive devices 41 are each arranged to be cooled by the cooling units 141, 142 described above. Specifically, as shown in FIG. 3, the cooling unit 141 is fixedly disposed between the drive devices 41 on the flexible boards 13*a*, 13*b*, and by the cooling unit 141 being pressed against these drive devices 41, the drive devices 41 are cooled. Similarly, the cooling unit 142 is fixedly disposed between the drive devices 41 on the flexible boards 13*c*, 13*d*, and by the cooling unit 142 being pressed against these drive devices 41, the drive devices 41 are cooled. It should be noted that such cooling units 141, 142 can each be configured using a variety of types of cooling mechanisms.

[Detailed Configuration of Flexible Boards 13*a*, 13*b*, 13*c*, and 13*d*]

Subsequently, a detailed configuration example of the flexible boards 13*a*, 13*b*, 13*c*, and 13*d* described above will be described with reference to FIG. 4A, FIG. 4B, FIG. 5, and FIG. 6 in addition to FIG. 1 through FIG. 3.

Figure 4A:
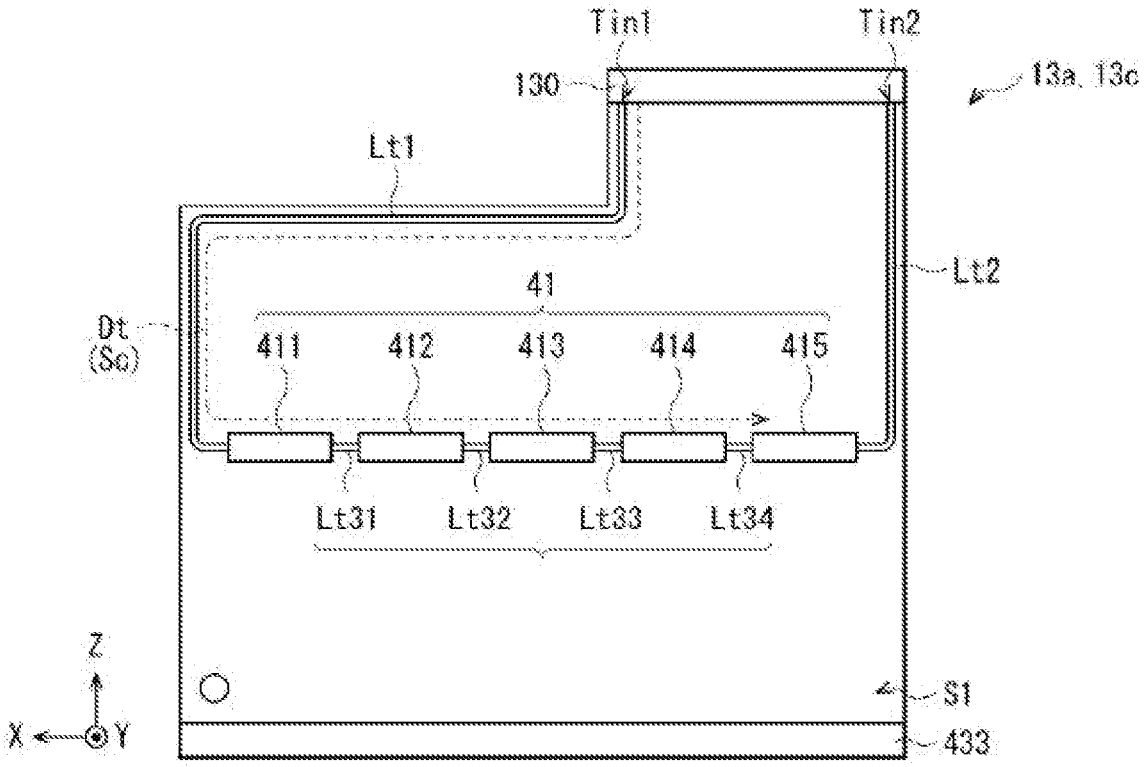
FIG. 4A is a plan view schematically showing a detailed configuration example of flexible boards shown in FIG. 2 and FIG. 3.
Figure 4B:
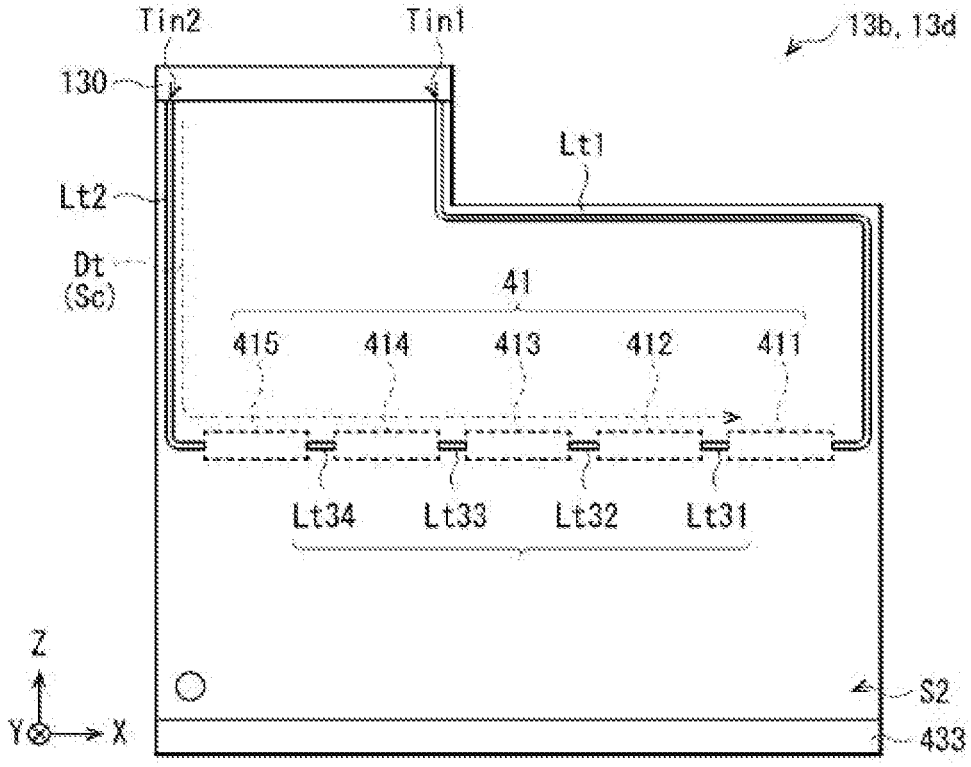
FIG. 4B is a plan view schematically showing a detailed configuration example of other flexible boards shown in FIG. 2 and FIG. 3.
Figure 5:
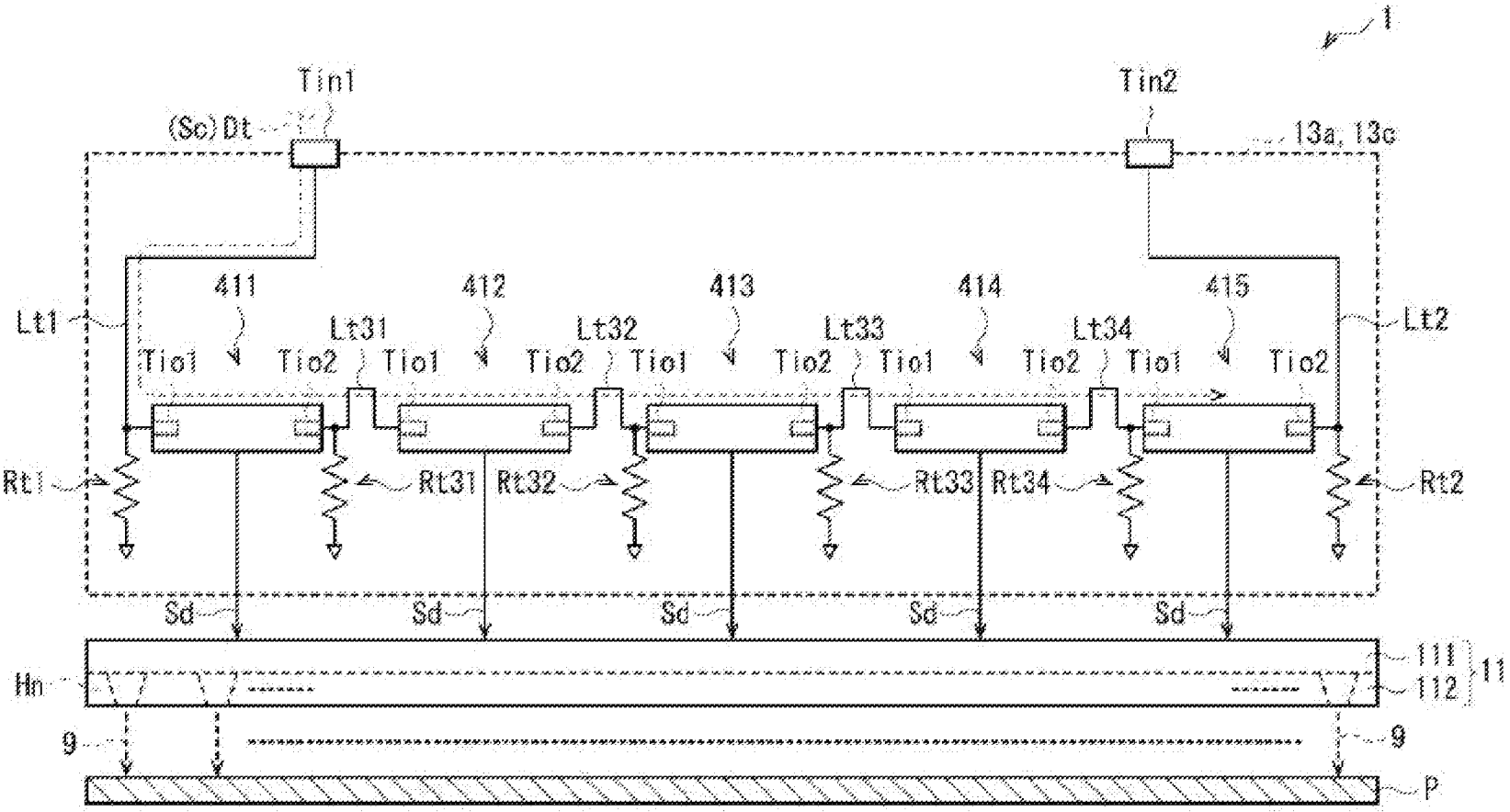
FIG. 5 is a schematic diagram showing an arrangement configuration example of members in the flexible board shown in FIG. 4A.
Figure 6:
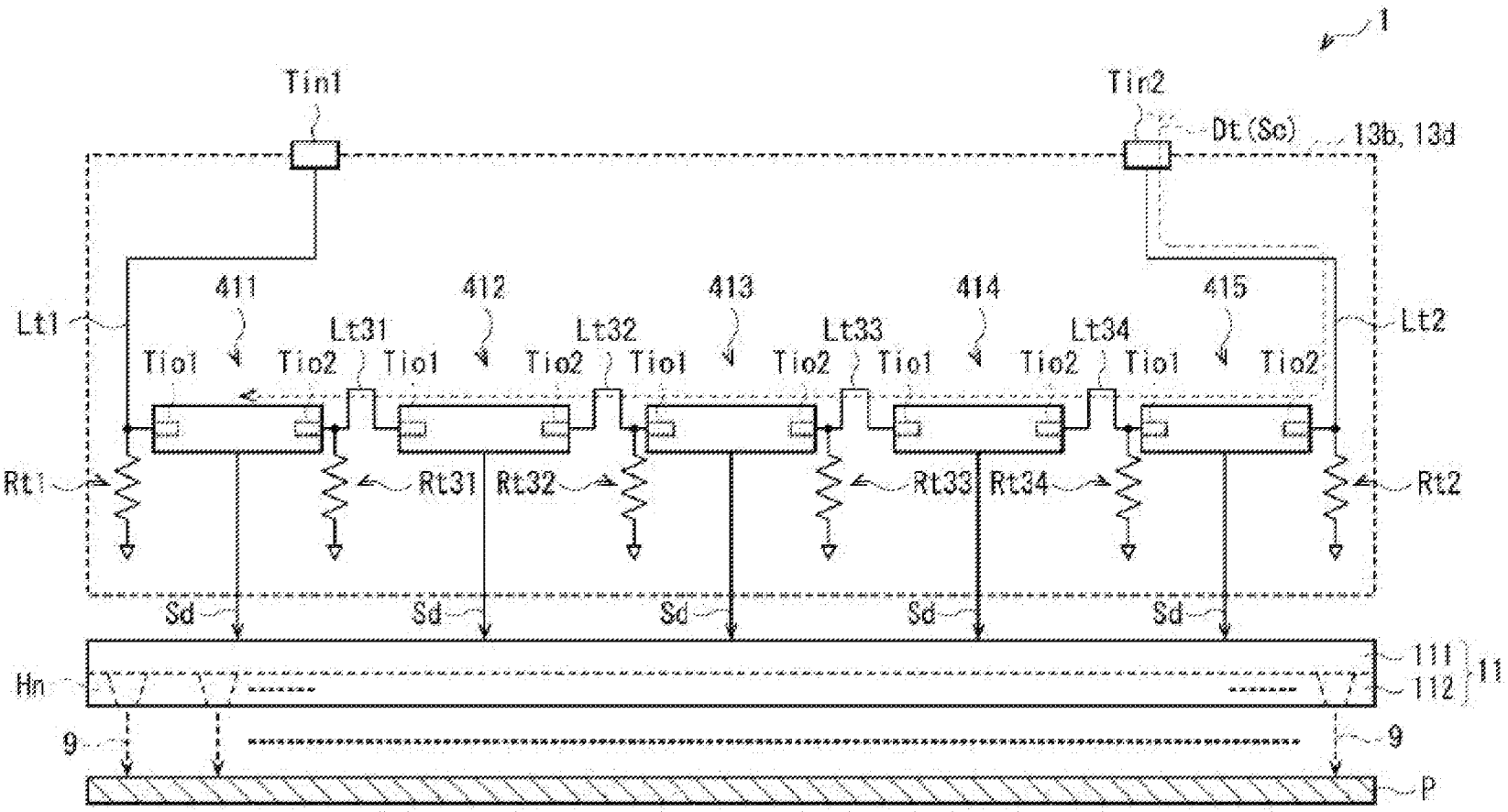
FIG. 6 is a schematic diagram showing an arrangement configuration example of members in the other flexible board shown in FIG. 4B.

FIG. 4A and FIG. 4B are plan views (Z-X plan views) schematically showing a detailed configuration example of the flexible boards 13*a* through 13*d* shown in FIG. 2 and FIG. 3. Specifically, FIG. 4A shows a planar configuration example (a Z-X planar configuration example) of the flexible boards 13*a*, 13*c*, and FIG. 4B shows a planar configuration example (a Z-X planar configuration example) of the flexible boards 13*b*, 13*d*. Further, FIG. 5 schematically shows an arrangement configuration example of the members in the flexible boards 13*a*, 13*c* shown in FIG. 4A, and FIG. 6 schematically shows an arrangement configuration example of the members in the flexible boards 13*b*, 13*d* shown in FIG. 4B.

First, as shown in each of FIG. 4A and FIG. 4B, the following members are provided to each of these flexible boards 13*a* through 13*d*. That is, there are provided a coupling electrode 130, a first input terminal Tint, a second input terminal Tin2, a first transmission line Lt1, a second transmission line Lt2, third transmission lines Lt31 through Lt34, a plurality of (five in this example) drive devices 41, and the clamping electrodes 433 described above.

The coupling electrode 130 is disposed in an end part area at the I/F board 12 side in each of the flexible boards 13*a* through 13*d*, and is an electrode for electrically coupling each of the flexible boards 13*a* through 13*d* and the I/F board 12 to each other.

It is arranged that transmission data Dt (the print control signal Sc described above) transmitted from the outside (the print control section 2 described above) of the inkjet head 1 is input to each of the first input terminal Tin1 and the second input terminal Tin2 (see FIG. 1, FIG. 2, FIG. 4A, and FIG. 4B). Further, it is arranged that such transmission data Dt is transmitted to the inside of each of the flexible boards 13*a* through 13*d* via one of the first input terminal Tin1 and the second input terminal Tin2. Specifically, as shown in, for example, FIG. 4A, it is arranged that in each of the flexible boards 13*a*, 13*c*, the transmission data Dt is transmitted to the inside of each of the flexible boards 13*a*, 13*c* via the first input terminal Tin1. Meanwhile, as shown in, for example, FIG. 4B, it is arranged that in each of the flexible boards 13*b*, 13*d*, the transmission data Dt is transmitted to the inside of each of the flexible boards 13*b*, 13*d* via the second input terminal Tin2.

The five drive devices 41 described above are mounted on each of the flexible boards 13*a* through 13*d* (at an obverse surface 51 side out of an obverse surface 51 and a reverse surface S2) in the example shown in FIG. 4A and FIG. 4B. As such five drive devices 41, in the example shown in FIG. 4A and FIG. 4B, there are disposed a single first drive device 411, a single second drive device 415, and three third drive devices 412 through 414. Further, these five drive devices 41 are disposed in series (cascaded) to each other between the first input terminal Tin1 and the second input terminal Tin2. Specifically, as shown in FIG. 4A and FIG. 4B, the first drive device 411, the third drive devices 412 through 414, and the second drive device 415 are disposed in series from the first input terminal Tin1 toward the second input terminal Tin2 in this order in all of the flexible boards 13*a* through 13*d*. In other words, the first drive device 411 is located at one end of the serial arrangement of such drive devices 41, and at the same time, the second drive device 415 is located at the other end of this serial arrangement. Further, the plurality of (three in this example) third drive devices 412 through 414 are located between the first drive device 411 and the second drive device 415. Each of these five drive devices 41 is arranged to generate the drive signal Sd described above based on the transmission data Dt input via one of the first input terminal Tin1 and the second input terminal Tin2 as described above. It should be noted that each of the drive signals Sd generated in such a manner is arranged to be supplied toward the jet section 11 via the clamping electrodes 433 described above on each of the flexible boards 13*a* through 13*d*.

Further, a plurality of transmission lines for transmitting the transmission data Dt via the five drive devices 41 arranged in series to each other are disposed between the first input terminal Tin1 and the second input terminal Tin2. Specifically, as shown in FIG. 4A and FIG. 4B, the first transmission line La is disposed between the first input terminal Tin1 and the first drive device 411, and the second transmission line Lt2 is disposed between the second input terminal Tin2 and the second drive device 415. Further, the third transmission line Lt31 is disposed between the first drive device 411 and the third drive device 412, and the third transmission line Lt32 is disposed between the third drive device 412 and the third drive device 413. The third transmission line Lt33 is disposed between the third drive device 413 and the third drive device 414, and the third transmission line Lt34 is disposed between the third drive device 414 and the second drive device 415.

Here, as described above, the input terminal (the first input terminal Tin1 or the second input terminal Tin2) to which the transmission data Dt is input is different (see FIG. 4A and FIG. 4B) between the flexible boards 13*a*, 13*c* and the flexible boards 13*b*, 13*d*. Further, in accordance therewith, the transmission direction inside the board of the transmission data Dt input is different between the flexible boards 13*a*, 13*c* and the flexible boards 13*b*, 13*d*. In other words, it is arranged that the transmission data Dt having been input from the first input terminal Tin1 is transmitted to the first drive device 411, the third drive devices 412, 413, and 414, and the second drive device 415 in this order (see FIG. 4A) in each of the flexible boards 13*a*, 13*c*. In contrast, it is arranged that the transmission data Dt having been input from the second input terminal Tin2 is transmitted to the second drive device 415, the third drive devices 414, 413, and 412, and the first drive device 411 in this order (see FIG. 4B) in each of the flexible boards 13*b*, 13*d*.

In such a manner, the input terminal to which the transmission data Dt is input and the transmission direction of transmission data Dt are different between the flexible boards 13*a*, 13*c* and the flexible boards 13*b*, 13*d*. It should be noted that the flexible boards 13*a*, 13*c* and the flexible boards 13*b*, 13*d* are made the same in the structure of the substrate itself as each other, and the configurations of the flexible boards 13*a* through 13*d* are commonalized (shared) (see FIG. 4A and FIG. 4B). In other words, although the details will be described later, there is no need to prepare a plurality of types of flexible boards (drive boards) in accordance with the transmission direction of the transmission data Dt and so on, and it becomes to dispose only a single type of flexible board (drive board) in the inkjet head 1.

Arrangement Configuration Example of Termination Resistor

Here, as shown in FIG. 5 and FIG. 6, the five drive devices 41 (the first drive device 411, the third drive devices 412 through 414, and the second drive device 415) described above each have a pair of input/output sections (input/output terminals) for performing input/output (input or output) of the transmission data Dt. Specifically, the first drive device 411, the third drive devices 412 through 414, and the second drive device 415 each have a first input/output section Tio1 and a second input/output section Tio2.

Therefore, as shown in FIG. 5 and FIG. 6, the first transmission line Lt1 described above is arranged to couple the first input terminal Tin1 and the first input/output section Tio1 in the first drive device 411 to each other. Further, the second transmission line Lt2 is arranged to couple the second input terminal Tin2 and the second input/output section Tio2 in the second drive device 415 to each other. Further, the four third transmission lines Lt31 through Lt34 couple the second input/output section Tio2 in the first drive device 411 and the first input/output section Tio1 in the second drive device 415 to each other via the three third drive devices 412 through 414. Specifically, the third transmission line Lt31 couples the second input/output section Tio2 in the first drive device 411 and the first input/output section Tio1 in the third drive device 412 to each other. Further, the third transmission line Lt32 couples the second input/output section Tio2 in the third drive device 412 and the first input/output section Tio1 in the third drive device 413 to each other. The third transmission line Lt33 couples the second input/output section Tio2 in the third drive device 413 and the first input/output section Tio1 in the third drive device 414 to each other. The third transmission line Lt34 couples the second input/output section Tio2 in the third drive device 414 and the first input/output section Tio1 in the second drive device 415 to each other.

Further, as shown in FIG. 5 and FIG. 6, such a plurality of termination resistors as described below are disposed on these transmission lines (the first transmission line Lt1, the second transmission line Lt2, and the third transmission lines Lt31 through Lt34). Specifically, on the first transmission line Lt1, there is disposed a first termination resistor Rt1 in the vicinity of the first input/output section Tio1 in the first drive device 411. Further, on the second transmission line Lt2, there is disposed a second termination resistor Rt2 in the vicinity of the second input/output section Tio2 in the second drive device 415.

Further, on the respective four third transmission lines Lt31 through Lt34, third termination resistors Rt31 through Rt34 are respectively disposed in the vicinity of one of an end and the other end. Specifically, as shown in FIG. 5 and FIG. 6, the third termination resistor Rt31 is disposed in the vicinity of one end (in the vicinity of an end part at the first drive device 411 side) on the third transmission line Lt31, namely in the vicinity of the second input/output section Tio2 in the first drive device 411. Further, the third termination resistor Rt32 is disposed in the vicinity of the other end (in the vicinity of an end part at the second drive device 415 side) on the third transmission line Lt32, namely in the vicinity of the first input/output section Tio1 in the third drive device 413. The third termination resistor Rt33 is disposed in the vicinity of one end (in the vicinity of an end part at the first drive device 411 side) on the third transmission line Lt33, namely in the vicinity of the second input/output section Tio2 in the third drive device 413. The third termination resistor Rt34 is disposed in the vicinity of the other end (in the vicinity of an end part at the second drive device 415 side) on the third transmission line Lt34, namely in the vicinity of the first input/output section Tio1 in the second drive device 415. In such a manner, in the example shown in FIG. 5 and FIG. 6, it is arranged that the third termination resistors Rt31 through Rt34 on the respective four third transmission lines Lt31 through Lt34 are alternately disposed in the vicinity of the end part at the first drive device 411 side and in the vicinity of the end part at the second drive device 415 side.

It should be noted that although the details will be described later, in general, it cannot be said that it is a preferable arrangement to dispose a termination resistor at the transmission end (output end) on the transmission line.

It should be noted that when the length (line length) of the transmission line for the cascade connection between the plurality of drive devices is relatively short, it can be said that it hardly matters if the position of the termination resistor is slightly shifted from the reception end (input end) as the preferable arrangement. Further, in the example shown in FIG. 5 and FIG. 6, it is arranged that each of the number (two) of the termination resistors disposed at the reception end side and the number (two) of the termination resistors disposed at the transmission end side is the same between when the transmission data Dt is input from the first input terminal Tin1 side (FIG. 5) and when the transmission data Dt is input from the second input terminal Tin2 side (FIG. 6). Thus, it is arranged to prevent a difference in transmission quality of the transmission data Dt from occurring depending on the input direction (the transmission direction) of the transmission data Dt.

Further, line lengths (L31 through L34) of such third transmission lines Lt31 through Lt34 are each set to a value smaller than ¼ of the signal wavelength λt obtained from the transmission frequency ft of the transmission data Dt (L31 through L34<λt×¼). Further, it is more preferable for each of the line lengths of the third transmission lines Lt31 through Lt34 to be set to a value smaller than ⅛ of the signal wavelength λt (L31 through L34<λt×⅛). This is because the value of ¼ corresponds to a phase of 90°, and is a limit value for such a short transmission line to be able to keep the transmission quality with which no transmission error occurs in a circuit at the reception side. Further, the value ⅛ corresponds to a phase of 45°, and can be said preferable since it is possible to suppress the deterioration of the transmission quality due to the phase shift to a lower level compared to the case of the value of ¼ as the limit value.

Here, the flexible boards 13*a* through 13*d* described above each correspond to a specific example of the "drive board" in the present disclosure. Further, the first input terminal Tin1 and the second input terminal Tin2 each correspond to a specific example of a "first input terminal" and a "second input terminal" in the present disclosure. Further, the first input/output section Tio1 and the second input/output section Tio2 each correspond to a specific example of a "first input/output section" and a "second input/output section" in the present disclosure. Further, the first drive device 411 corresponds to a specific example of a "first drive device" in the present disclosure, the second drive device 415 corresponds to a specific example of a "second drive device" in the present disclosure, and the third drive devices 412 through 414 each correspond to a specific example of a "third drive device" in the present disclosure. Further, the first transmission line Lt1 corresponds to a specific example of a "first transmission line" in the present disclosure, the second transmission line Lt2 corresponds to a specific example of a "second transmission line" in the present disclosure, and the third transmission lines Lt31 through Lt34 each correspond to a specific example of a "third transmission line" in the present disclosure. Further, the first termination resistor Rt1 corresponds to a specific example of a "first termination resistor" in the present disclosure, the second termination resistor Rt2 corresponds to a specific example of a "second termination resistor" in the present disclosure, and the third termination resistors Rt31 through Rt34 each correspond to a specific example of a "third termination resistor" in the present disclosure.

[Operations and Functions/Advantages]

(A. Basic Operation of Printer 5)

In the printer 5, a recording operation (a printing operation) of images, characters, and so on to the recording target medium (the recording paper P and so on) is performed using a jet operation of the ink 9 by such an inkjet head 1 as described below. Specifically, in the inkjet head 1 according to the present embodiment, the jet operation of the ink 9 using a shear mode is performed in the following manner.

First, the drive devices 41 on each of the flexible boards 13*a*, 13*b*, 13*c*, and 13*d* each apply the drive voltage Vd (the drive signal Sd) to the drive electrodes (the common electrode and the active electrode) described above in the actuator plate 111 in the jet section 11. Specifically, each of the drive devices 41 applies the drive voltage Vd to the drive electrodes disposed on the pair of drive walls partitioning the ejection channel described above. Thus, the pair of drive walls each deform so as to protrude toward the dummy channel adjacent to the ejection channel.

On this occasion, it results in that the drive wall makes a flexion deformation to have a V shape centering on the intermediate position in the depth direction in the drive wall. Further, due to such a flexion deformation of the drive wall, the ejection channel deforms as if the ejection channel bulges. As described above, due to the flexion deformation caused by a piezoelectric thickness-shear effect in the pair of drive walls, the volume of the ejection channel increases. Further, by the volume of the ejection channel increasing, the ink 9 is induced into the ejection channel as a result.

Subsequently, the ink 9 having been induced into the ejection channel in such a manner turns to a pressure wave to propagate to the inside of the ejection channel. Then, the drive voltage Vd to be applied to the drive electrodes becomes 0 (zero) V at the timing at which the pressure wave has reached the nozzle hole Hn of the nozzle plate 112 (or timing in the vicinity of that timing). Thus, the drive walls are restored from the state of the flexion deformation described above, and as a result, the volume of the ejection channel having once increased is restored again.

In such a manner, the pressure in the ejection channel increases in the process that the volume of the ejection channel is restored, and thus, the ink 9 in the ejection channel is pressurized. As a result, the ink 9 having a droplet shape is ejected (see FIG. 1) toward the outside (toward the recording paper P) through the nozzle hole Hn. The jet operation (the ejection operation) of the ink 9 in the inkjet head 1 is performed in such a manner, and as a result, the recording operation of images, characters, and so on to the recording paper P is performed.

(B. Functions/Advantages in Inkjet Head 1)

Subsequently, functions and advantages in the inkjet head 1 according to the present embodiment will be described in detail while compared to a configuration example (FIG. 7A through FIG. 7C, FIG. 8A, and FIG. 8B) of a typical termination resistor in the related art.

B-1. Regarding Configuration Example of Typical Termination Resistor

FIG. 7A through FIG. 7C, FIG. 8A, and FIG. 8B are each a circuit diagram showing an arrangement configuration example of a typical termination resistor in the transmission line.

First, in recent years, the fast differential transmission such as LVDS (Low Voltage Differential Signaling) has become to be used many times inside the inkjet printer. Therefore, it matters how efficiently the fast differential lines are laid around in the inkjet head which is small in size. As a problem which occurs on that occasion, there can be cited a method of arranging the termination resistor on such a fast differential lines.

In recent years, there exists a device which can cope with the bidirectional transmission, namely in which the same port can be used as the reception end (the input end) and also as the transmission end (the output end). Such a device capable of performing the bidirectional transmission is suitable to increase the density of the component and the interconnections on the board, and is therefore very important in such a circuit required to be reduced in size as one located inside the inkjet head. In the typical inkjet head in the related art, such drive devices capable of performing the bidirectional transmission are used, and the cascade connection (series connection) of these drive devices is simplified to achieve an increase in circuit density.

However, in the inkjet head in recent years, in order to achieve an increase in production efficiency when performing printing, speeding up when transmitting the print data is required, and accordingly, such fast differential transmission as described above has become necessary. As such fast differential transmission, there has been known a variety of transmission method such as CML (Current Mode Logic) in addition to LVDS described above, and basically, it is arranged that the terminal resistor having the same value as the characteristic impedance of the fast differential lines is disposed at the reception end (the input end).

Figure 7A:
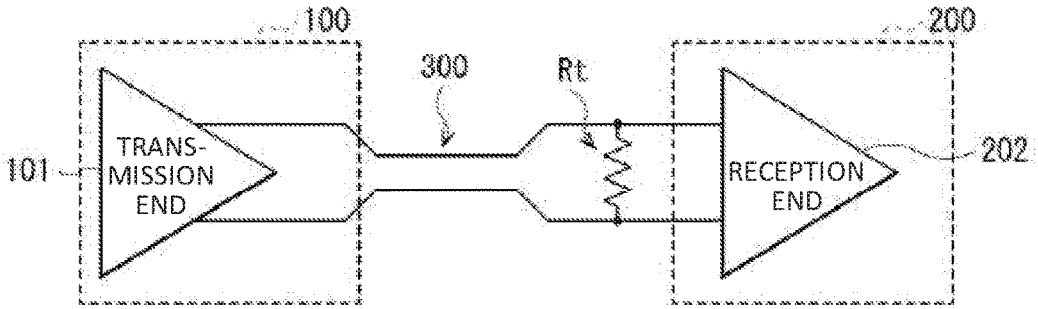
FIG. 7A is a circuit diagram showing an arrangement configuration example of a typical termination resistor in a transmission line.
Figure 7B:
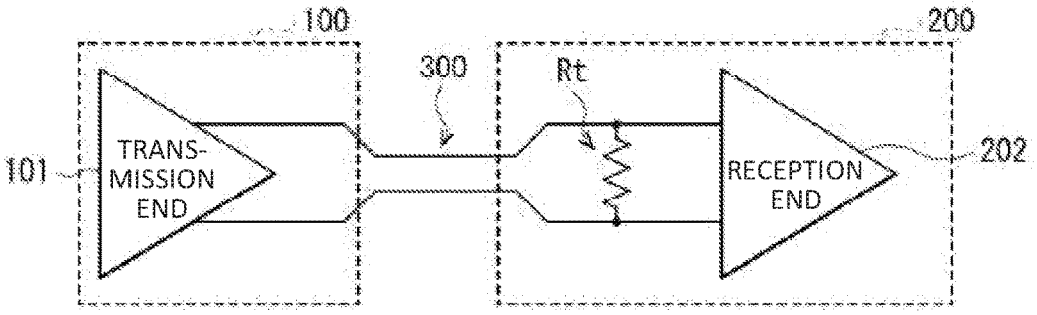
FIG. 7B is a circuit diagram showing another arrangement configuration example of a typical termination resistor in a transmission line.
Figure 7C:
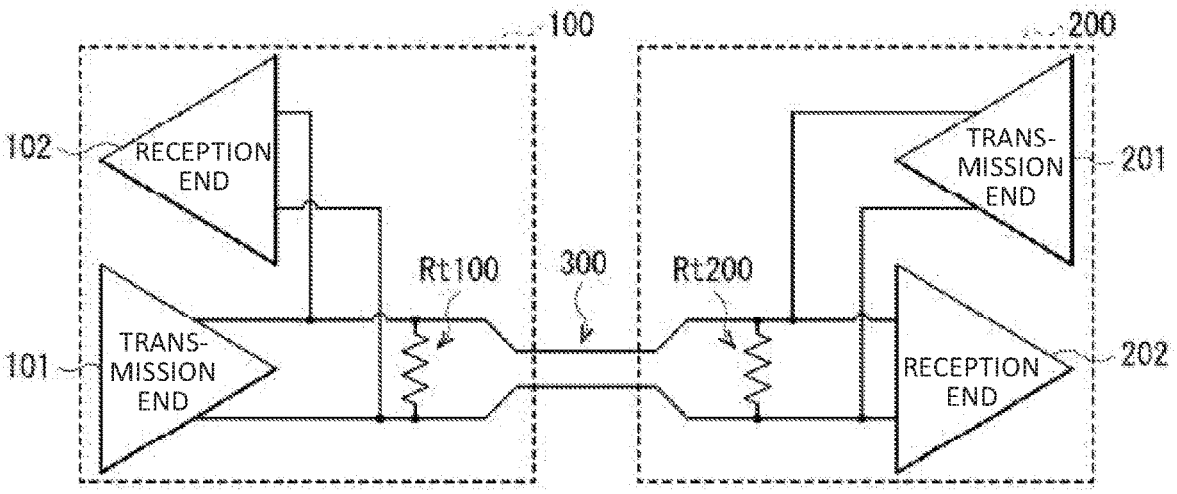
FIG. 7C is a circuit diagram showing another arrangement configuration example of typical termination resistors in a transmission line.

Specifically, it is arranged that when differential lines 300 as the fast differential lines are coupled between a transmission end 101 in a device 100 and a reception end 202 in a device 200 as shown in, for example, FIG. 7A, a termination resistor Rt is disposed at the input side of the reception end 202. Further, in the example shown in FIG. 7B, the termination resistor Rt is disposed at an input part of such a reception end 202 in the inside of the device 200.

Here, in such a transmission scheme (a method of performing the LVDS transmission from a single transmission end to a plurality of reception ends) of a so-called "multi-drop" type as described in, for example, Document 1, it is arranged that the termination resistor is disposed only to one of the reception ends. This is because when disposing the termination resistors to all of the reception ends, the termination resistance value becomes low, and thus, a heavy load is applied to a device at the reception side. It should be noted that when the termination resistor is disposed only to one of the reception ends in such a manner, in the reception end at a position relatively far from the termination resistor, there occurs reflection of the high-frequency signal, and thus, the quality of the digital signal waveform deteriorates, and therefore, the transmission error due to, for example, an error in the H (High)/L (Low) determination becomes apt to occur. Further, in order to solve this problem, a degree of freedom of an arrangement of the termination resistor and the devices is significantly decreased as a result.

Therefore, in the devices (the drive devices) in the inkjet head, the cascade connection described above for outputting the input data transmitted using the LVDS to the drive device in the posterior stage is performed in some cases when performing the data transmission to a plurality of drive devices. By performing such cascade connection, such a problem of the termination resistor as in the "multi-drop" type described above seems to be solved.

However, when adopting the cascade connection, there is a problem. Specifically, for example, in the inkjet head, in general, a plurality of nozzle arrays are operated by the drive devices in many cases, and therefore, a plurality of boards (drive boards) for driving the plurality of nozzle arrays also become necessary in many cases. Further, in such a case, the plurality of drive substrates are disposed in a flipped manner with respect to a metal member (a cooling unit or the like) in, for example, the inkjet head in many cases. Incidentally, as described above using FIG. 3, in the inkjet head 1 according to the present embodiment, the flexible boards 13*a*, 13*c* and the flexible boards 13*b*, 13*d* as the plurality of drive boards are disposed in a flipped manner with respect to the cooling units 141, 142.

Further, in such a case, the reception end (the input end) in the plurality of cascaded drive devices is exchanged depending on the arrangement direction in some cases as shown in, for example, FIG. 4A and FIG. 4B described above. Then, in order to cope with this, there occurs a necessity of preparing a plurality of types of drive boards if this goes on. Specifically, it is assumed that the termination resistors are supposedly disposed at the first input terminal Tin1 side (the reception end side (the input end side) in this case) in the respective drive devices 41 in the flexible boards 13*a*, 13*c* as the drive boards shown in FIG. 4A. Further, when applying such an arrangement configuration of the termination resistors also to the flexible boards 13*b*, 13*d* as the drive boards shown in FIG. 4B, the termination resistors are disposed at the transmission end side (the output end side) of the respective drive devices 41 as a result. Therefore, in such an arrangement configuration example of the termination resistors, it becomes unachievable to perform the effective data transmission, and therefore, in this case, there occurs a necessity of preparing two types of drive boards as a result.

When the plurality of types of drive boards become necessary in such a manner, when manufacturing the inkjet head, an increase in the management cost is incurred.

Therefore, in order to avoid such an increase in the management cost, it is desirable to reduce the types of the drive boards, but in that case, there arises a necessity of disposing the input/output terminals (input/output sections) capable of performing the bidirectional transmission in each of the drive devices. The drive board compatible with the bidirectional transmission can be achieved with relative ease in, for example, slow single-ended communication, but in the fast differential transmission such as the LVDS described above, the problem of the termination resistor is inevitably brought out.

For example, when the two drive devices cascaded to each other become compatible with the bidirectional transmission, the termination resistors become necessary at the both ends of the transmission line coupled to these two drive devices. Specifically, in the example shown in FIG. 7C, the termination resistors Rt100, Rt200 are disposed at the both ends of the differential lines 300 coupled between the two devices 100, 200 compatible with the bidirectional transmission. Specifically, the termination resistor Rt100 is disposed in the vicinity of the transmission end 101 and a reception end 102 in the device 100, and at the same time, the termination resistor Rt200 is disposed in the vicinity of a transmission end 201 and the reception end 202 in the device 200.

In the case of the plurality of drive devices cascaded to each other in such a manner, when the termination resistors are disposed at the both ends of the transmission line, the voltage amplitude level satisfied at the reception end halves, and therefore, in order to compensate the voltage amplitude level, it is necessary to increase, for example, the current used in the transmission from the transmission end. In other words, in this case, the current consumption when performing the data transmission increases as a result.

Incidentally, it is possible to adopt a method of switching between an ON state (a valid state) and an OFF state (an invalid state) of the termination resistor by selective mounting of a control terminal or a component in order to avoid such an increase in current consumption. Specifically, in an example shown in FIG. 8A and FIG. 8B, switches SW1, SW2 for individually switching between the ON state and the OFF state of the termination resistors Rt100, Rt200 are additionally disposed in the configuration example shown in FIG. 7C described above.

Figure 8A:
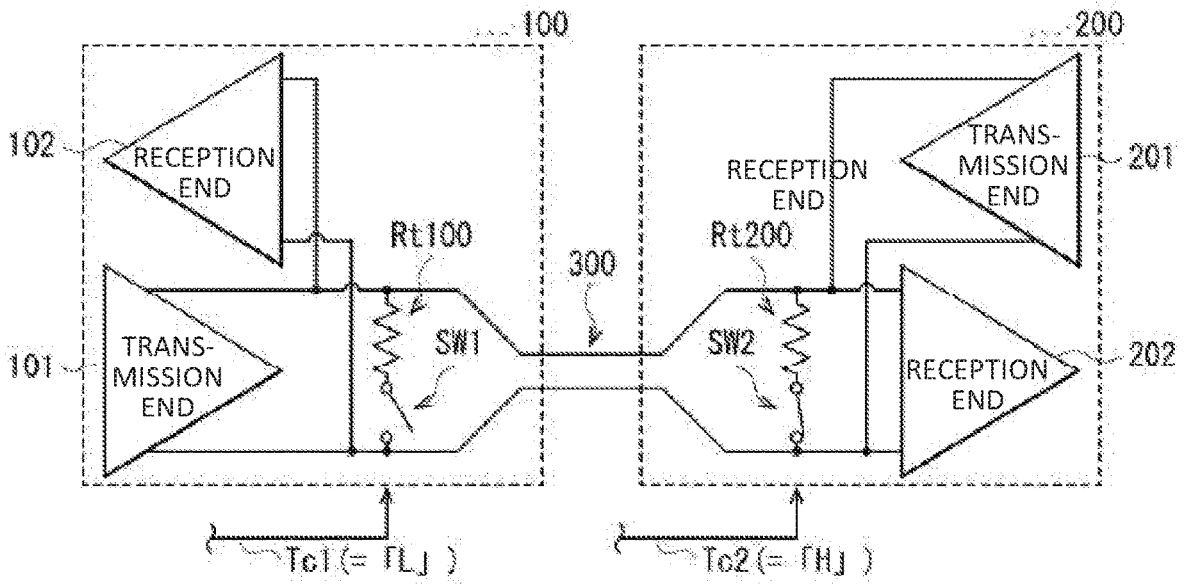
FIG. 8A is a circuit diagram showing another arrangement configuration example of typical termination resistors in a transmission line.
Figure 8B:
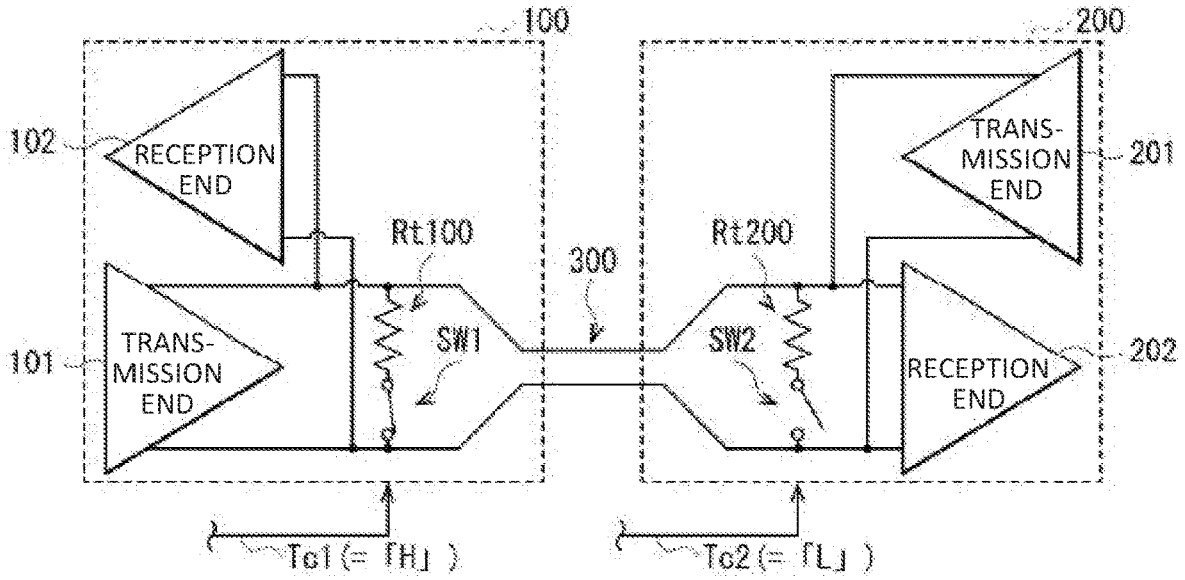
FIG. 8B is a circuit diagram showing another arrangement configuration example of typical termination resistors in a transmission line.

Here, in the case of FIG. 8A, a control terminal Tc1 is set to an "L" state to thereby set the switch SW1 to the OFF state, and at the same time, a control terminal Tc2 is set to an "H" state to thereby set the switch SW2 to the ON state. In other words, in the case of FIG. 8A, since the termination resistor Rt100 out of the two termination resistors Rt100, Rt200 located at the both ends of the differential lines 300 is set to the invalid state, only the termination resistor Rt200 is set to the valid state. In contrast, in the case of FIG. 8B, the control terminal Tc1 is set to the "H" state to thereby set the switch SW1 to the ON state, and at the same time, the control terminal Tc2 is set to the "L" state to thereby set the switch SW2 to the OFF state. In other words, in the case of FIG. 8B, since the termination resistor Rt200 out of the two termination resistors Rt100, Rt200 located at the both ends of the differential lines 300 is set to the invalid state, only the termination resistor Rt100 is set to the valid state.

However, in such a method, the additional control terminals and components (the switches and so on) cause a significant stress on the drive board for the inkjet head which is already high in mounting density and wiring density. Further, the selective mounting of a component is a method which should be avoided as strictly as possible from a viewpoint of the management of the manufacture of the drive board. In other words, in considering the arrangement configuration of the termination resistors, such a method of switching between the valid state and the invalid state of the termination resistor can be said to be undesirable.

In such a manner, in the configuration example of the typical termination resistors in the related art, the management cost of the drive board increases, or the current consumption when performing the data transmission increases. As a result, in the configuration example of the typical termination resistors, it can be said that there is a possibility that the manufacturing cost of the inkjet head and the power consumption increase.

(B-2. Functions/Advantages)

In contrast, in the inkjet head 1 according to the present embodiment, since the following configuration is adopted, it is possible to obtain, for example, the following functions and advantages.

That is, first, in the inkjet head 1, it is arranged that the transmission data Dt is exclusively input via one of the first input terminal Tin1 and the second input terminal Tin2 in each of the flexible boards 13*a*, 13*b*, 13*c*, and 13*d*. Further, it is arranged that the transmission data Dt is input/output in a bidirectional manner between the plurality of drive devices 41 disposed in series (cascaded) to each other between the first input terminal Tin1 and the second input terminal Tin2. Specifically, it is arranged that the transmission data Dt is input/output in the bidirectional manner via the plurality of transmission lines (the first transmission line Lt1, the second transmission line Lt2, and the third transmission lines Lt31 through Lt34), the first input/output sections Tio1 and the second input/output sections Tio2.

Thus, it becomes possible to commonalize (share) the configuration of the flexible boards 13*a*, 13*c* in which the transmission data Dt is input from the first input terminal Tin1 and the configuration of the flexible boards 13*b*, 13*d* in which the transmission data Dt is input from the second input terminal Tin2 when using the plurality of flexible boards 13*a*, 13*b*, 13*c*, and 13*d* in the inkjet head 1. As a result, in the inkjet head 1, the management cost of the flexible boards 13*a*, 13*b*, 13*c*, and 13*d* as the drive boards can be suppressed.

Here, when the transmission data Dt is input from the first input terminal Tin1 (see FIG. 5), the first termination resistor Rt1 disposed in the vicinity of the reception end (the first input/output section Tio1 in the first drive device 411) on the first transmission line Lt1 functions as the termination resistor when inputting the transmission data Dt from the outside of the inkjet head 1. In contrast, when the transmission data Dt is input from the second input terminal Tin2 (see FIG. 6), the second termination resistor Rt2 disposed in the vicinity of the reception end (the second input/output section Tio2 in the second drive device 415) on the second transmission line Lt2 functions as the termination resistor when inputting the transmission data Dt from the outside of the inkjet head 1.

Further, in either of the cases described above (see FIG. 5, FIG. 6), the third termination resistors Rt31 through Rt34 disposed on each of the third transmission lines Lt31 through Lt34 function as the termination resistors when transmitting the transmission data Dt (when performing the data transmission) between the drive devices 41 disposed in series to each other. Further, such third termination resistors Rt31 through Rt34 are disposed in one of the vicinity of one end and the vicinity of the other end on the third transmission lines Lt31 through Lt34, respectively. Thus, it is possible to suppress the current consumption when performing the data transmission between the drive devices 41 compared to when, for example, disposed in the vicinity of the both ends on the third transmission lines described above (e.g., the case of FIG. 7C described above).

According to the above, in the present embodiment, it is possible to suppress the current consumption when performing the data transmission while suppressing the management cost of the flexible boards 13*a*, 13*b*, 13*c*, and 13*d* as the drive boards. As a result, in the present embodiment, it becomes possible to reduce both of the manufacturing cost of the inkjet head 1 and the power consumption.

Further, in the present embodiment, when the three or more drive devices 41 are disposed in series to each other, the third termination resistors Rt31 through Rt34 on each of the third transmission lines Lt31 through Lt34 are alternately disposed. Specifically, in the vicinity of the end part at the first drive device 411 side and in the vicinity of the end part at the second drive device 415 side, these third termination resistors Rt31 through Rt34 are alternately disposed. Thus, the difference in arrangement position between the third termination resistors Rt31 through Rt34 is reduced (a variation in arrangement position is reduced) between when the transmission data Dt is input from the first input terminal Tin1 (see FIG. 5) and when the transmission data Dt is input from the second input terminal Tin2 (see FIG. 6). Therefore, the quality when performing the data transmission between the drive devices 41 is substantially homogenized in these cases (see FIG. 5 and FIG. 6), and as a result, it becomes possible to realize the stable data transmission.

Further, in the present embodiment, since the line lengths L31 through L34 of the third transmission lines Lt31 through Lt34 are set to the values (L31 through L34$<\lambda t\times 1/4$) smaller than ¼ of the signal wavelength $\lambda t$ described above, the following is achieved. That is, when the transmission data Dt is transmitted on the third transmission lines Lt31 through Lt34, even when the third termination resistors Rt31 through Rt34 are located at the transmission end (the output end) instead of the reception end (the input end) in accordance with the transmission direction of the transmission data Dt, the degradation (the deterioration of the transmission signal) of the quality when performing the data transmission hardly occurs. As a result, it becomes possible to realize the stable data transmission.

2. Modified Examples

Then, some modified examples (Modified Example 1 through Modified Example 4) of the embodiment described above will be described. It should be noted that hereinafter, the same constituents as those in the embodiment are denoted by the same reference symbols, and the description thereof will arbitrarily be omitted.

Modified Example 1 Through Modified Example 3

(Configuration)

Figure 9:
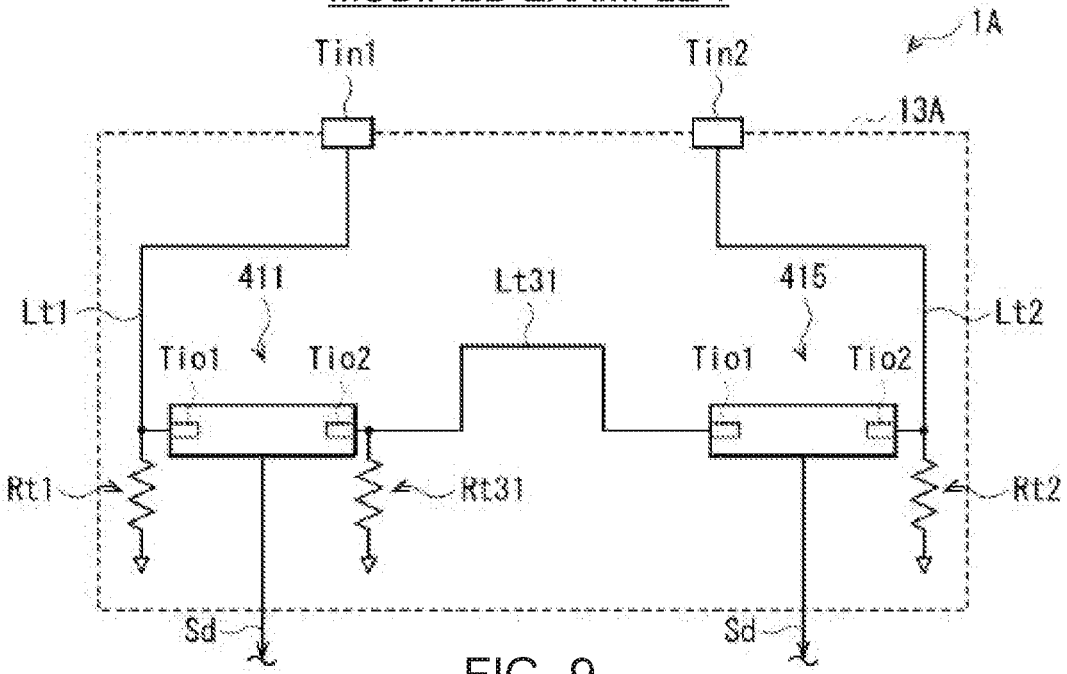
FIG. 9 is a schematic diagram showing an arrangement configuration example of members in a flexible board in a liquid jet head according to Modified Example 1.
Figure 10:
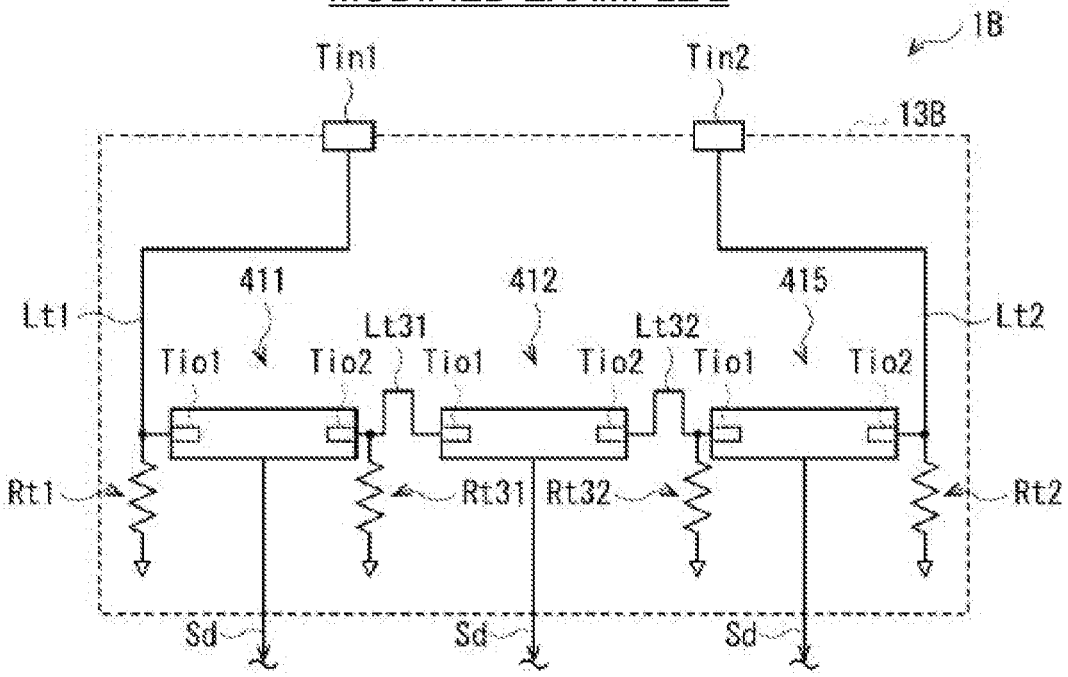
FIG. 10 is a schematic diagram showing an arrangement configuration example of members in a flexible board in a liquid jet head according to Modified Example 2.
Figure 11:
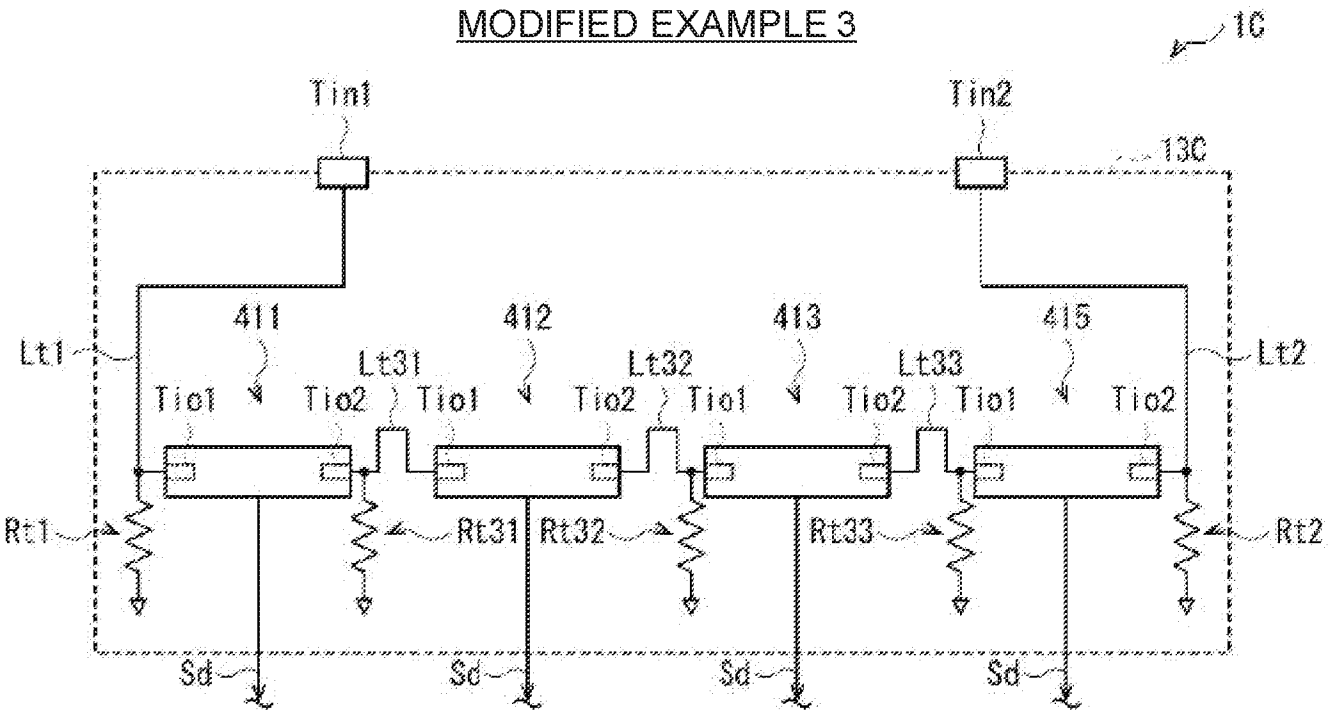
FIG. 11 is a schematic diagram showing an arrangement configuration example of members in a flexible board in a liquid jet head according to Modified Example 3.

FIG. 9 is a diagram schematically showing an arrangement configuration example of members in a flexible board 13A in a liquid jet head (an inkjet head 1A) according to Modified Example 1. Further, FIG. 10 is a diagram schematically showing an arrangement configuration example of members in a flexible board 13B in a liquid jet head (an inkjet head 1B) according to Modified Example 2. FIG. 11 is a diagram schematically showing an arrangement configuration example of members in a flexible board 13C in a liquid jet head (an inkjet head 1C) according to Modified Example 3.

It should be noted that these inkjet heads 1A through 1C each correspond to a specific example of the "liquid jet head" in the present disclosure. Further, a printer equipped with any one of these inkjet heads 1A through 1C corresponds to a specific example of the "liquid jet recording device" in the present disclosure.

First, in the inkjet head 1A according to Modified Example 1 shown in FIG. 9, the following members are disposed in the flexible board 13A having the first input terminal Tin1 and the second input terminal Tin2. That is, in the flexible board 13A, there are disposed the first drive device 411, the second drive device 415, the first transmission line Lt1, the second transmission line Lt2, the third transmission line Lt31, the first termination resistor Rt1, the second termination resistor Rt2, and the third termination resistor Rt31. The flexible board 13A is obtained by modifying the flexible boards 13*a* through 13*d* in the embodiment shown in FIG. 5 and FIG. 6 in such a manner as described below, and the rest of the configuration is basically the same. That is, the flexible board 13A is obtained by omitting (being not provided with) the three third drive devices 412 through 414, and at the same time, omitting the three third transmission lines Lt32 through Lt34, and the three third termination resistors Rt32 through Rt34. Further, the third termination resistor Rt31 is disposed in the vicinity of one end (in the vicinity of the end part at the first drive device 411 side) on the third transmission line Lt31, namely in the vicinity of the second input/output section Tio2 in the first drive device 411.

Further, in the inkjet head 1B according to Modified Example 2 shown in FIG. 10, the following members are disposed in the flexible board 13B having the first input terminal Tin1 and the second input terminal Tin2. That is, in the flexible board 13B, there are disposed the first drive device 411, the second drive device 415, the third drive device 412, the first transmission line Lt1, the second transmission line Lt2, the third transmission lines Lt31, Lt32, the first termination resistor Rt1, the second termination resistor Rt2, and the third termination resistors Rt31, Rt32. The flexible board 13B is obtained by modifying the flexible board 13A in Modified Example 1 shown in FIG. 9 in such a manner as described below, and the rest of the configuration is basically the same. That is, the flexible board 13B is obtained by further providing the third drive device 412, and at the same time, further providing the third transmission line Lt32, and the third termination resistor Rt32. Further, the third termination resistor Rt32 is disposed in the vicinity of the other end (in the vicinity of the end part at the second drive device 415 side) on the third transmission line Lt32, namely in the vicinity of the first input/output section Tio1 in the second drive device 415.

Further, in the inkjet head 1C according to Modified Example 3 shown in FIG. 11, the following members are disposed in the flexible board 13C having the first input terminal Tin1 and the second input terminal Tin2. That is, in the flexible board 13C, there are disposed the first drive device 411, the second drive device 415, the third drive devices 412, 413, the first transmission line Lt1, the second transmission line Lt2, the third transmission lines Lt31, Lt32, Lt33, the first termination resistor Rt1, the second termination resistor Rt2, and the third termination resistors Rt31, Rt32, R33. The flexible board 13C is obtained by modifying the flexible board 13B in Modified Example 2 shown in FIG. 10 in such a manner as described below, and the rest of the configuration is basically the same. That is, the flexible board 13C is obtained by further providing the third drive device 413, and at the same time, further providing the third transmission line Lt33, and the third termination resistor Rt33. Further, the third termination resistor Rt33 is disposed in the vicinity of the other end (in the vicinity of the end part at the second drive device 415 side) on the third transmission line Lt33, namely in the vicinity of the first input/output section Tio1 in the second drive device 415. Therefore, in the Modified Example 3, unlike the embodiment, Modified Example 1, and Modified Example 2 described above, the three third termination resistors Rt31 through Rt34 are not alternately disposed in the vicinity of the end part at the first drive device 411 side and in the vicinity of the end part at the second drive device 415 side, as a result.

(Functions/Advantages)

In Modified Example 1 through Modified Example 3 having such configurations, it is also possible to obtain basically the same advantages due to substantially the same function as that of the embodiment. Specifically, it is possible to suppress the current consumption when performing the data transmission while suppressing the management cost of the flexible boards 13A, 13B, 13C as the drive boards. As a result, it becomes possible to reduce both of the manufacturing cost of the inkjet heads 1A through 1C and the power consumption.

Modified Example 4

Figure 12A:
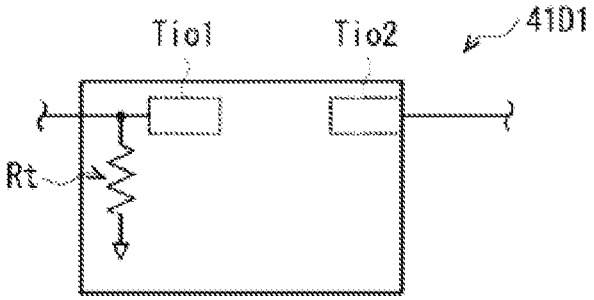
FIG. 12A is a schematic diagram showing an arrangement configuration example of a termination resistor in a drive device according to Modified Example 4.
Figure 12B:
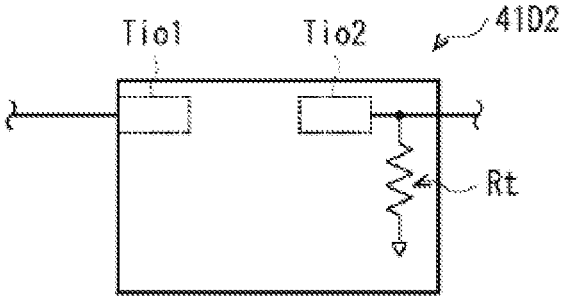
FIG. 12B is a schematic diagram showing another arrangement configuration example of a termination resistor in a drive device according to Modified Example 4.

FIG. 12A and FIG. 12B are diagrams schematically showing the arrangement configuration example of the termination resistor Rt in drive devices 41D1, 41D2 in Modified Example 4. Specifically, FIG. 12A shows the arrangement configuration example of the termination resistor Rt in the drive device 41D1, and FIG. 12B shows the arrangement configuration example of the termination resistor Rt in the drive device 41D2.

It should be noted that the inkjet heads respectively provided with these drive devices 41D1, 41D2 each correspond to a specific example of the "liquid jet head" in the present disclosure. Further, printers respectively equipped with those inkjet heads each correspond to a specific example of the "liquid jet recording device" in the present disclosure.

First, in the drive device 41D1 shown in FIG. 12A, the termination resistor Rt is disposed inside (in the inside at the first input/output section Tio1 side) the drive device 41D1. The termination resistor Rt corresponds to at least one of the termination resistors (the first termination resistor Rt1, the second termination resistor Rt2, and the third termination resistors Rt31 through Rt34) described hereinabove.

In contrast, in the drive device 41D2 shown in FIG. 12B, the termination resistor Rt is disposed inside (in the inside at the second input/output section Tio2 side) the drive device 41D2. The termination resistor Rt also corresponds to at least one of the termination resistors described hereinabove.

Since at least one of the first termination resistor Rt1, the second termination resistor Rt2, and the third termination resistors Rt31 through Rt34 is disposed (incorporated) inside the drive devices 41D1, 41D2 in Modified Example 4 in such a manner, the following is achieved. That is, on the flexible boards 13*a*, 13*b*, 13*c*, and 13*d* as the drive boards, reduction of the mounting components and circuit scale can be achieved. As a result, in Modified Example 4, it becomes possible to further reduce the manufacturing cost of the inkjet head, and to achieve reduction in size of the inkjet head.

3. Other Modified Examples

The present disclosure is described hereinabove citing the embodiment and some modified examples, but the present disclosure is not limited to the embodiment and so on, and a variety of modifications can be adopted.

For example, in the embodiment and so on described above, the description is presented specifically citing the configuration examples (the shapes, the arrangements, the number and so on) of each of the members in the printer 5 and the inkjet heads 1, 1A through 1C, but what described in the above embodiment and so on is not a limitation, and it is possible to adopt other shapes, arrangements, numbers and so on.

Specifically, for example, in the embodiment and so on described above, the description is presented specifically citing the configuration examples of the flexible board (the drive board), the drive device, the transmission line, the termination resistor, and so on, but these configuration examples are not limited to those described in the above embodiment and so on. For example, in the embodiment and so on described above, the description is presented citing when the "drive board" in the present disclosure is the flexible board as an example, but the "drive board" in the present disclosure can also be, for example, a nonflexible board.

Further, the numerical examples of the variety of parameters described in the above embodiment and so on are not limited to the numerical examples described in the embodiment and so on, and can also be other numerical values. Specifically, in the above embodiment and so on, for example, the description is presented citing when the line lengths L31 through L34 of the third transmission lines Lt31 through Lt34 are set to the values (L31 through L34$<\lambda t\times 1/4$) smaller than ¼ of the signal wavelength λt described above as an example, but this example is not a limitation. Specifically, in some cases, for example, it is possible for at least one of the line lengths L31 through L34 to be a value no smaller than ¼ of the signal wavelength λt (L31 through L34$\geq\lambda t\times 1/4$).

Further, as the structure of the inkjet head, it is possible to apply those of a variety of types. Specifically, for example, it is possible to adopt a so-called side-shoot type inkjet head which emits the ink 9 from a central portion in the extending direction of each of the ejection channels in the actuator plate 111. Alternatively, it is possible to adopt, for example, a so-called edge-shoot type inkjet head for ejecting the ink 9 along the extending direction of each of the ejection channels. Further, the type of the printer is not limited to the type described in the embodiment and so on described above, and it is possible to apply a variety of types such as an MEMS (Micro Electro-Mechanical Systems) type.

Further, for example, it is possible to apply the present disclosure to either of an inkjet head of a circulation type which uses the ink 9 while circulating the ink 9 between the ink tank and the inkjet head, and an inkjet head of a non-circulation type which uses the ink 9 without circulating the ink 9.

Further, the series of processes described in the above embodiment and so on can be arranged to be performed by hardware (a circuit), or can also be arranged to be performed by software (a program). When arranging that the series of processes is performed by the software, the software is constituted by a program group for making the computer perform the functions. The programs can be incorporated in advance in the computer described above and are then used, or can also be installed in the computer described above from a network or a recording medium and are then used.

Further, in the above embodiment and so on, the description is presented citing the printer 5 (the inkjet printer) as a specific example of the "liquid jet recording device" in the present disclosure, but this example is not a limitation, and it is also possible to apply the present disclosure to other devices than the inkjet printer. In other words, it is also possible to arrange that the "liquid jet head" (the inkjet head) of the present disclosure is applied to other devices than the inkjet printer. Specifically, it is also possible to arrange that the "liquid jet head" of the present disclosure is applied to a device such as a facsimile or an on-demand printer.

In addition, it is also possible to apply the variety of examples described hereinabove in arbitrary combination.

It should be noted that the advantages described in the specification are illustrative only but are not a limitation, and other advantages can also be provided.

Further, the present disclosure can also take the following configurations.

<1> A liquid jet head configured to jet liquid comprising: a jet section configured to jet the liquid; and at least one drive board configured to output a drive signal used to jet the liquid to the jet section, wherein the drive board includes: a first input terminal and a second input terminal to which transmission data transmitted from an outside of the liquid jet head is input, a plurality of drive devices which are in a series arrangement with each other between the first input terminal and the second input terminal, and which is configured to generate the drive signal based on the transmission data input via either one of the first input terminal and the second input terminal, a plurality of transmission lines which are disposed via the plurality of drive devices which are in the series arrangement with each other between the first input terminal and the second input terminal, and which are configured to transmit the transmission data, and a plurality of termination resistors disposed on the plurality of transmission lines, the drive devices each have a first input/output section and a second input/output section which are configured to input or output the transmission data, the plurality of drive devices include: a first drive device located at one end of the series arrangement, and a second drive device located at another end of the series arrangement, the plurality of transmission lines include: a first transmission line configured to couple the first input terminal and the first input/output section in the first drive device to each other, a second transmission line configured to couple the second input terminal and the second input/output section in the second drive device to each other, and at least one third transmission line configured to couple the second input/output section in the first drive device and the first input/output section in the second drive device to each other, and the plurality of termination resistors include: a first termination resistor disposed in a vicinity of the first input/output section in the first drive device on the first transmission line, a second termination resistor disposed in a vicinity of the second input/output section in the second drive device on the second transmission line, and a third termination resistor disposed in a vicinity of one end or another end on each of the at least one third transmission line.

<2> The liquid jet head according to <1>, wherein the plurality of drive devices further include at least one third drive device located between the first drive device and the second drive device in the serial arrangement, the plurality of third transmission lines couple the second input/output section in the first drive device and the first input/output section in the second drive device to each other via the at least one third drive device, and the third termination resistors on each of the third transmission lines are alternately disposed in a vicinity of an end part at the first drive device side and in a vicinity of an end part at the second drive device side.

<3> The liquid jet head according to <1> or <2>, wherein a line length in the at least one third transmission line is set to a value smaller than ¼ of a signal wavelength obtained from a transmission frequency of the transmission data.

<4> The liquid jet head according to any one of <1> to <3>, wherein at least one of the first termination resistor, the second termination resistor, and the third termination resistor is disposed inside the drive device.

<5> A liquid jet recording device comprising the liquid jet head according to any one of <1> to <4>.

What is claimed is:

1. A liquid jet head configured to jet liquid comprising:

a jet section configured to jet the liquid; and at least one drive board configured to output a drive signal used to jet the liquid to the jet section, wherein the drive board includes:

a first input terminal and a second input terminal to which transmission data transmitted from an outside of the liquid jet head is input, a plurality of drive devices which are in a series arrangement with each other between the first input terminal and the second input terminal, and which is configured to generate the drive signal based on the transmission data input via either one of the first input terminal and the second input terminal, a plurality of transmission lines which are disposed via the plurality of drive devices which are in the series arrangement with each other between the first input terminal and the second input terminal, and which are configured to transmit the transmission data, and a plurality of termination resistors disposed on the plurality of transmission lines, the drive devices each have a first input/output section and a second input/output section which are configured to input or output the transmission data, the plurality of drive devices include:

a first drive device located at one end of the series arrangement, and a second drive device located at another end of the series arrangement, the plurality of transmission lines include:

a first transmission line configured to couple the first input terminal and the first input/output section in the first drive device to each other, a second transmission line configured to couple the second input terminal and the second input/output section in the second drive device to each other, and at least one third transmission line configured to couple the second input/output section in the first drive device and the first input/output section in the second drive device to each other, and the plurality of termination resistors include:

a first termination resistor disposed in a vicinity of the first input/output section in the first drive device on the first transmission line, a second termination resistor disposed in a vicinity of the second input/output section in the second drive device on the second transmission line, and a third termination resistor disposed in a vicinity of one end or another end on each of the at least one third transmission line.

2. The liquid jet head according to claim 1, wherein the plurality of drive devices further include at least one third drive device located between the first drive device and the second drive device in the serial arrangement, the plurality of third transmission lines couple the second input/output section in the first drive device and the first input/output section in the second drive device to each other via the at least one third drive device, and the third termination resistors on each of the third transmission lines are alternately disposed in a vicinity of an end part at the first drive device side and in a vicinity of an end part at the second drive device side.

3. The liquid jet head according to claim 1, wherein a line length in the at least one third transmission line is set to a value smaller than ¼ of a signal wavelength obtained from a transmission frequency of the transmission data.

4. The liquid jet head according to claim 1, wherein at least one of the first termination resistor, the second termination resistor, and the third termination resistor is disposed inside the drive device.

5. A liquid jet recording device comprising the liquid jet head according to claim 1.

* * * * *